US009995549B1

(12) United States Patent
Hamby

(10) Patent No.: US 9,995,549 B1
(45) Date of Patent: Jun. 12, 2018

(54) BOLT HOLD OPEN, FIRE SELECTOR AND SAFETY FOR KALASHNIKOV STYLE WEAPONS

(71) Applicant: David Marion Hamby, Montgomery, TX (US)

(72) Inventor: David Marion Hamby, Montgomery, TX (US)

( * ) Notice: Subject to any disclaimer, the term of this patent is extended or adjusted under 35 U.S.C. 154(b) by 0 days. days.

(21) Appl. No.: 15/473,559

(22) Filed: Mar. 29, 2017

(51) Int. Cl.

| | |
|---|---|
| ***F41A 17/00*** | (2006.01) |
| ***F41A 19/46*** | (2006.01) |
| ***F41A 35/06*** | (2006.01) |
| ***F41A 3/66*** | (2006.01) |
| ***F41A 3/72*** | (2006.01) |

(52) U.S. Cl.
CPC ..... *F41A 19/46* (2013.01); *F41A 3/66* (2013.01); *F41A 3/72* (2013.01); *F41A 35/06* (2013.01)

(58) Field of Classification Search
USPC .... 42/70.08, 70.04, 70.06; 89/132, 148, 150
See application file for complete search history.

(56) References Cited

U.S. PATENT DOCUMENTS

| | | | |
|---|---|---|---|
| 4,523,510 | A | 6/1985 | Wilhelm |
| 4,594,934 | A | 6/1986 | Holstein et al. |
| 5,251,533 | A | 10/1993 | Layton |
| 5,760,328 | A | 6/1998 | Robbins |
| 7,261,029 | B1 | 8/2007 | Davis |
| 7,654,187 | B2 | 2/2010 | Hochstrate et al. |
| 7,806,039 | B1 | 10/2010 | Gomez |
| 7,878,106 | B2 | 2/2011 | Hu |
| 8,276,502 | B1 | 10/2012 | Wright |
| 8,359,966 | B1 | 1/2013 | Brotherton |
| 8,549,982 | B2 | 10/2013 | Troy, Jr. et al. |
| 8,707,606 | B2 | 4/2014 | Hoel |
| 8,756,847 | B2 | 6/2014 | Huther |
| D723,646 | S | 3/2015 | Keezer |
| 9,068,790 | B2 | 6/2015 | La Vigne |
| 9,091,499 | B2 | 7/2015 | Overstreet et al. |
| 9,103,615 | B2 | 8/2015 | Mikroulis |
| 9,146,066 | B1 | 9/2015 | Cason |
| 9,194,638 | B2 | 11/2015 | Larson, Jr. et al. |
| 9,372,043 | B2 | 6/2016 | Larson, Jr. et al. |
| 9,494,375 | B2 | 11/2016 | Mikroulis |
| 9,541,339 | B2 | 1/2017 | Orne, III et al. |

(Continued)

FOREIGN PATENT DOCUMENTS

| | | |
|---|---|---|
| WO | 1999005467 A1 | 2/1999 |

*Primary Examiner* — J. Woodrow Eldred
(74) *Attorney, Agent, or Firm* — Hamby Law Firm; Bruce W. Hamby

(57) ABSTRACT

This disclosure describes embodiments of an apparatus which will be called a bolt hold open, fire selector and safety. This apparatus is for ambidextrously holding open the bolt of a Kalashnikov style firearm; for ambidextrously selecting whether the Kalashnikov style firearm will fire multiple rounds or a single round each time the user pulls and holds down the trigger on the firearm when the firearm contains an auto sear mounting pin; for ambidextrously selecting whether the Kalashnikov style firearm will fire a single round each time the user pulls and holds down the trigger on the firearm when the firearm does not contain an auto sear mounting pin; and for ambidextrously selecting whether the Kalashnikov style firearm will fire when the user pulls the trigger on the firearm.

24 Claims, 6 Drawing Sheets

(56) References Cited

U.S. PATENT DOCUMENTS

| | | | | |
|---|---|---|---|---|
| 9,557,128 | B2 * | 1/2017 | Miller, III | F41A 17/46 |
| 9,587,897 | B1 * | 3/2017 | Huang | F41A 17/00 |
| 2008/0302235 | A1 | 12/2008 | Lauck | |
| 2016/0187090 | A1 * | 6/2016 | Mather | F41A 17/46<br>42/70.06 |

* cited by examiner

BOLT HOLD OPEN, FIRE SELECTOR AND SAFETY FOR KALASHNIKOV STYLE WEAPONS

BRIEF DESCRIPTION OF THE DRAWINGS

In FIG. 7, the Kalashnikov style weapon's dust cover, recoil spring assembly and bolt carrier group are depicted as removed and not yet reassembled.

In FIG. 8, the Kalashnikov style weapon's dust cover, recoil spring assembly and bolt carrier group are depicted as removed and not yet reassembled.

In FIG. 9, the Kalashnikov style weapon's dust cover, recoil spring assembly and bolt carrier group are depicted as removed and not yet reassembled.

FIG. 10 depicts an embodiment of a rigid hold open member extending from the external part of the single rigid member of the primary selector piece so as to conformably engage the front of the firearm's charging handle in such a manner that prevents the bolt of the firearm from closing for so long as the hold open member is engaging the front of the firearm's charging handle.

DETAILED DESCRIPTION OF THE EMBODIMENTS

An apparatus is disclosed which will be called a bolt hold open, fire selector and safety. This bolt hold open, fire selector and safety is also referred to sometimes as:

- an apparatus for ambidextrously holding open the bolt of a Kalashnikov style firearm;
- apparatus for ambidextrously selecting whether a Kalashnikov style firearm, having a left receiver, a right receiver, an auto sear mounting pin, a primary keyhole, a secondary mounting hole, a hammer and a disconnector, will fire multiple rounds or a single round each time the user pulls a trigger on the firearm;
- an apparatus for ambidextrously selecting whether a Kalashnikov style firearm, having a left receiver, a right receiver, a primary keyhole, a secondary mounting hole, a hammer and a disconnector, will fire a single round each time the user pulls a trigger on the firearm; and
- an apparatus for ambidextrously selecting whether the Kalashnikov style firearm will fire when the user pulls the trigger on the firearm.

The term Kalashnikov style firearm includes weapons such as the AK-47, AK-74, Saiga, Vepr and similar firearms, as well as firearms whose designs are approximately similar to, or are directly or indirectly derived from, the disclosure made by Mikhail T. Kalashnikov et al. in the International Application Published Under the Patent Cooperation Treaty as WO 99/05467 A1, styled "Automatic weapon 'Kalashnikov Assault Rifle'".

Figure 4:
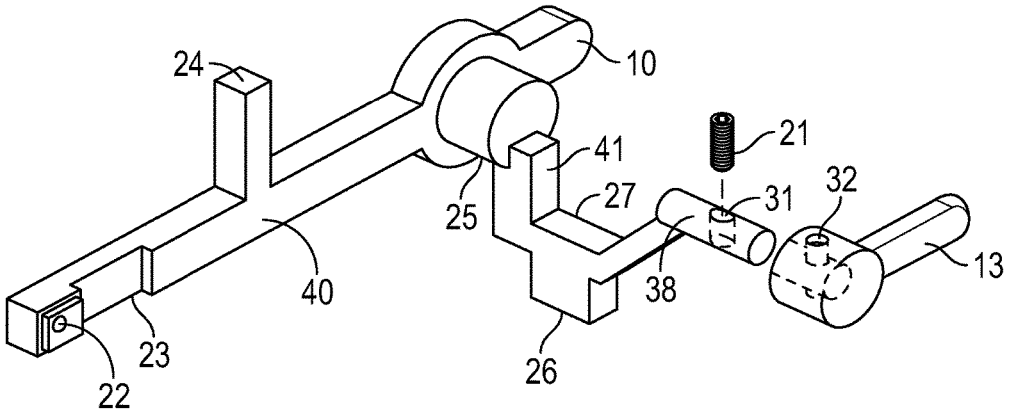
FIG. 4 is an isometric illustration of how to assemble an embodiment, in one form, of a bolt hold open, fire selector and safety by assembling an embodiment of a primary selector piece, an embodiment of a left thumb piece operatively configured to provide leverage to a user rotating the primary selector piece and an embodiment of a means for fastening the primary selector piece to the left thumb piece, where the means for fastening the primary selector piece to the left thumb piece comprises a socket set screw.

As shown by FIG. 4, in one embodiment, the bolt hold open, fire selector and safety is an apparatus that is comprised of three components: a primary selector piece, 40, a left thumb piece operatively configured to provide leverage to a user rotating the primary selector piece, 13, and a means for fastening the primary selector piece to the left thumb piece, 21; in the embodiment depicted in FIG. 4, the means for fastening the primary selector piece to the left thumb piece is a socket set screw, 21, which is screwed through the threaded hole for socket set screw in left thumb piece, 32, and also through the threaded hole for socket set screw in means for pivoting on secondary mounting hole that possesses an insertion space conformably made to accommodate a means for fastening the primary selector piece to the left thumb piece, 38, thus rigidly affixing the primary selector piece, 40, to the left thumb piece operatively configured to provide leverage to a user rotating the primary selector piece, 13.

The embodiment illustrated in FIG. 4 further shows an insertion space conformably made to accommodate a means for fastening the primary selector piece to the left thumb piece, 31; in the embodiment shown in FIG. 4, 31 is threaded. However, in other embodiments 31 may not be threaded and in still other embodiments may be configured in any manner necessary to accommodate a means for fastening the primary selector piece to the left thumb piece.

Figure 6:
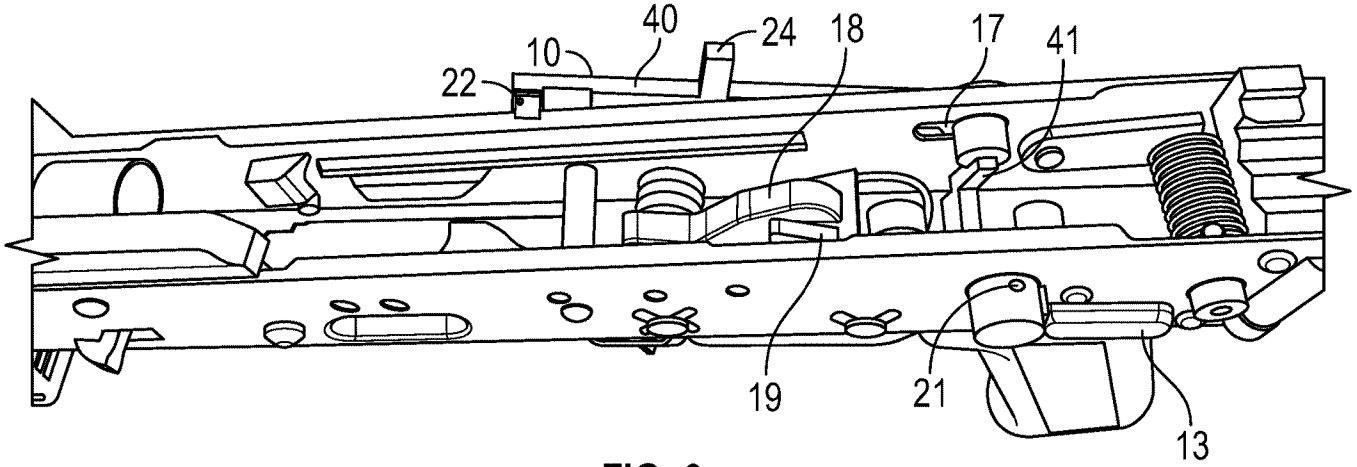
FIG. 6 is an isometric illustration of the position of an embodiment, in one form, of the bolt hold open, fire selector and safety in a Kalashnikov style weapon when in the safe configuration when the dust cover, recoil spring assembly and bolt carrier group have been removed and not yet reassembled.

The embodiment illustrated in FIG. 4 further shows a primary selector piece, 40, that comprises a single rigid member, which is comprised of: an external part which extends laterally along the right receiver, 39, (depicted in one embodiment in FIG. 1, in one embodiment in FIG. 10 and in one embodiment in FIG. 11) and an internal part which is approximately orthogonal to the external part and which extends through the primary keyhole in the right receiver and through the secondary mounting hole in the left receiver, 41 (also depicted in one embodiment in FIG. 6).

FIG. 4 further shows that an external part of the primary selector piece which extends laterally along the right receiver, 39, is comprised of: a means for creating friction between the external part and the receiver, 22, a means for conformably clearing the auto sear mounting pin by allowing the external part to pass over the auto sear mounting pin, 23, a rigid hold open member extending from the external part so as to conformably engage the front of the firearm's charging handle in such a manner that prevents the bolt of the firearm from closing for so long as the hold open member is engaging the front of the firearm's charging handle, 24, and a right thumb piece operatively configured to provide leverage to a user rotating the primary selector piece, 10.

FIG. 4 further shows that an internal part of the primary selector piece, 41, is comprised of: a means for pivoting on keyhole passthrough, 25, a means for blocking mechanism which is capable of blocking the disconnector and the trigger assembly, 26, a means for permitting reciprocation of bolt carrier assembly, 27, and a means for pivoting on secondary mounting hole that possesses an insertion space conformably made to accommodate a means for fastening the primary selector piece to the left thumb piece, 38.

Figure 5:
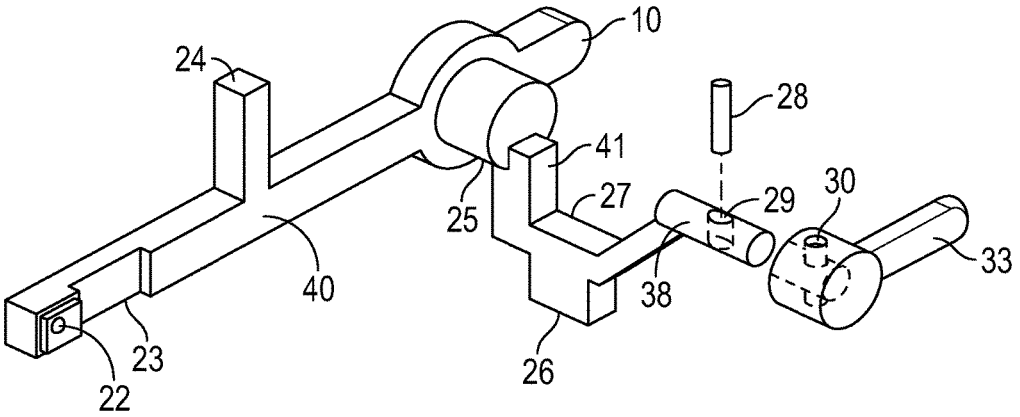
FIG. 5 is an isometric illustration of how to assemble an embodiment, in one form, of a bolt hold open, fire selector and safety by assembling an embodiment of a primary selector piece, an embodiment of a left thumb piece operatively configured to provide leverage to a user rotating the primary selector piece and an embodiment of a means for fastening the primary selector piece to the left thumb piece, where the means for fastening the primary selector piece to the left thumb piece comprises a roll pin.

FIG. 5 shows another embodiment of the bolt hold open, fire selector and safety. In FIG. 5, the means for fastening the primary selector piece to the left thumb piece is a roll pin, 28, which is inserted through nonthreaded hole for roll pin in left thumb piece, 30, and through, nonthreaded hole for roll pin in means for pivoting on secondary mounting hole, 29, thus rigidly affixing the primary selector piece, 40, to the nonthreaded left thumb piece operatively configured to provide leverage to a user rotating the primary selector piece, 33.

Figure 1:
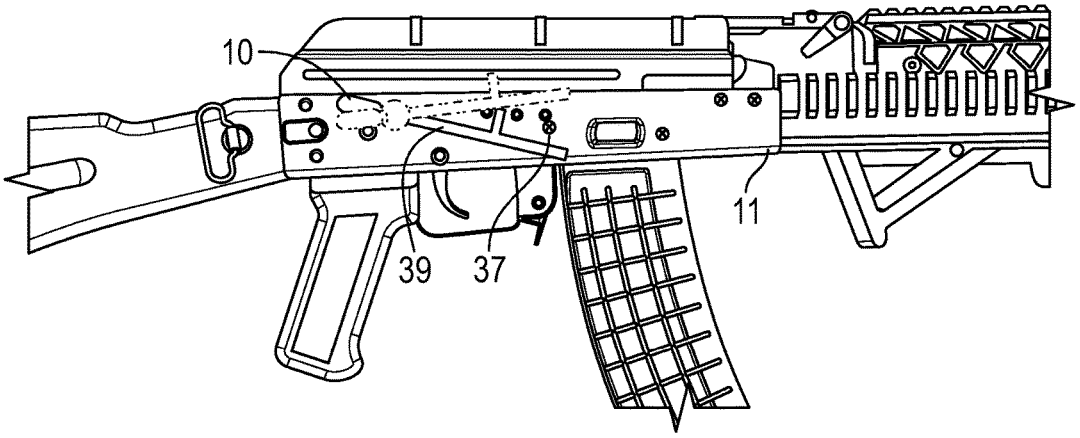
FIG. 1 is an isometric view of an embodiment, in one form, of a bolt hold open, fire selector and safety on a Kalashnikov style weapon viewed from the right side of the weapon, with the solid line showing the bolt hold open, fire selector and safety in the fire configuration for semi-automatic fire and the ghost line showing the bolt hold open, fire selector and safety in the safe configuration.

The embodiment illustrated in FIG. 1 shows the existence of an auto sear mounting pin, 37, on the right receiver, 11. The auto sear mounting pin, 37, corresponds to the means for conformably clearing the auto sear mounting pin by allowing the external part to pass over the auto sear mounting pin, 23, shown in the embodiments depicted in FIG. 4 and FIG. 5. FIG. 1 further shows an embodiment of the right thumb piece operatively configured to provide leverage to a user rotating the primary selector piece, 10.

FIG. 1 further shows an embodiment in which the solid line in the illustration shows an external part of the primary selector piece which extends laterally along the right receiver, 39, in the fire configuration for semi-automatic fire and the ghost line shows 39 in the safe configuration.

The safe configuration and the semi-automatic fire configuration are not the only configuration embodiments that can be activated by the bolt hold open, fire selector and safety. For example, in another embodiment, it is possible for the bolt hold open, fire selector and safety to support a fully automatic fire configuration on a Kalashnikov style weapon that contains a sear that permits full automatic fire capability. In such an embodiment, a right thumb piece operatively configured to provide leverage to a user rotating the primary selector piece, 10, could be positioned in a configuration that is between the safe configuration and the semi-automatic fire configuration that are depicted in FIG. 1. In such a fully automatic fire embodiment, the means for blocking mechanism which is capable of blocking the disconnector and the trigger assembly, 26, would block the disconnector, 34, when the trigger, but not the trigger assembly, 19, is continuously pulled.

unlike the Kalashnikov style weapon shown in FIG. 1, certain models of Kalashnikov style weapons are built without any auto sear mounting pin, 37, on the right receiver, 11. In such cases, another embodiment of the bolt hold open, fire selector and safety can be used in which the means for conformably clearing the auto sear mounting pin by allowing the external part to pass over the auto sear mounting pin, 23, is omitted.

Figure 2:
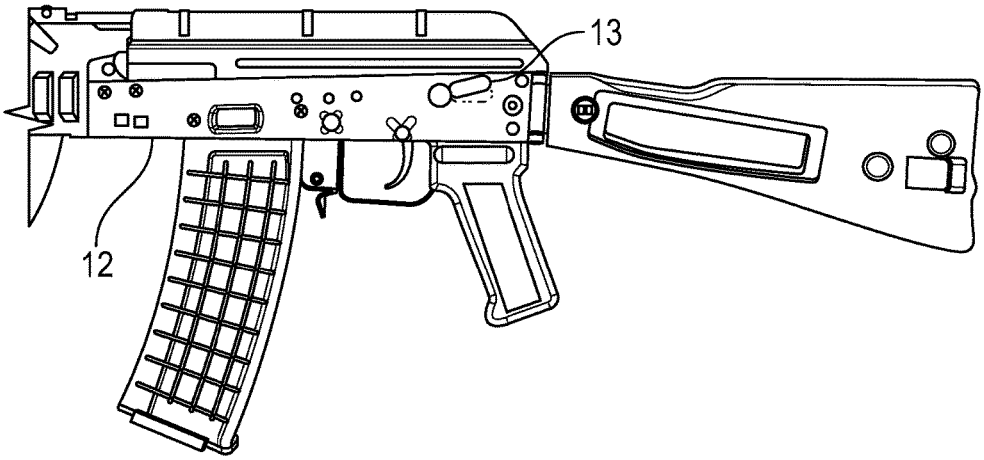
FIG. 2 is an isometric view of an embodiment, in one form, of the bolt hold open, fire selector and safety on a Kalashnikov style weapon from the left side of the weapon, with the solid line showing the bolt hold open, fire selector and safety in the fire configuration for semi-automatic fire and the ghost line showing the bolt hold open, fire selector and safety in the safe configuration.

FIG. 2 shows an embodiment of a left thumb piece operatively configured to provide leverage to a user rotating the primary selector piece, 13, and its relationship to the left receiver, 12.

FIG. 2 further shows an embodiment in which the solid line for 13 in the illustration shows the bolt hold open, fire selector and safety in the fire configuration for semi-automatic fire and the ghost line for 13 shows the bolt hold open, fire selector and safety in the safe configuration.

Figure 3:
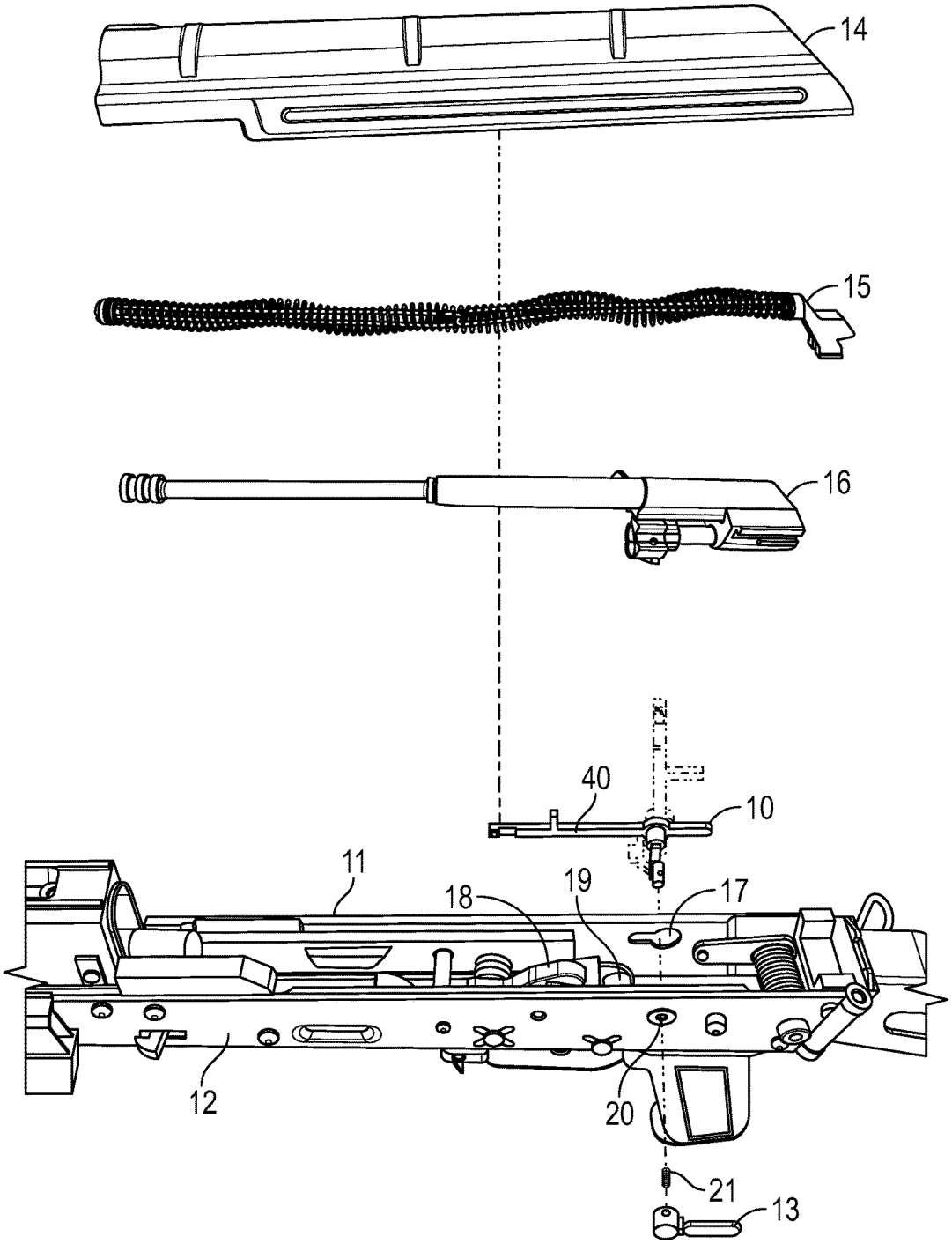
FIG. 3 is an isometric semi-exploded view of a Kalashnikov style weapon from the top left side of the weapon, showing how parts of a Kalashnikov style weapon disassemble, how to insert and assemble an embodiment, in one form, of a bolt hold open, fire selector and safety in a Kalashnikov style weapon and how parts of a Kalashnikov style weapon reassemble.

FIG. 3. shows how an embodiment of the bolt hold open, fire selector and safety can be installed in a Kalashnikov style weapon. First, the dust cover, 14, is removed, followed by the recoil spring assembly, 15, and the bolt carrier assembly, 16. The primary selector piece, 40, is then oriented as shown by the ghosted lines in FIG. 3 so that the internal part of the single rigid member of the primary selector piece can be passed through the primary keyhole, 17.

After the internal part of the single rigid member of the primary selector piece has passed through the primary keyhole, the primary selector piece, 40, is then oriented as shown by the solid lines in FIG. 3 so that the external part of the single rigid member of the primary selector piece extends laterally along the right receiver, 11 (the right receiver 11, is shown in the embodiment depicted in FIG. 1), and so that the means for pivoting on secondary mounting hole that possesses an insertion space conformably made to accommodate a means for fastening the primary selector piece to the left thumb piece, 38, (shown in the embodiments depicted in FIG. 4 and FIG. 5) extends through the secondary mounting hole, 20.

FIG. 3 shows an embodiment in which a means for fastening the primary selector piece to the left thumb piece, 21, (in this embodiment a socket set screw), is then used to rigidly affix the primary selector piece, 40, to the left thumb piece operatively configured to provide leverage to a user rotating the primary selector piece, 13, thus completing the assembly of an embodiment of a bolt hold open, fire selector and safety.

As shown in the embodiment depicted in FIG. 3, the bolt carrier assembly, 16, is then reinstalled, followed by the recoil spring assembly, 15, and by the dust cover, 14, in order to complete the installation of an embodiment of the bolt hold open, fire selector and safety in a Kalashnikov style weapon.

Figure 7:
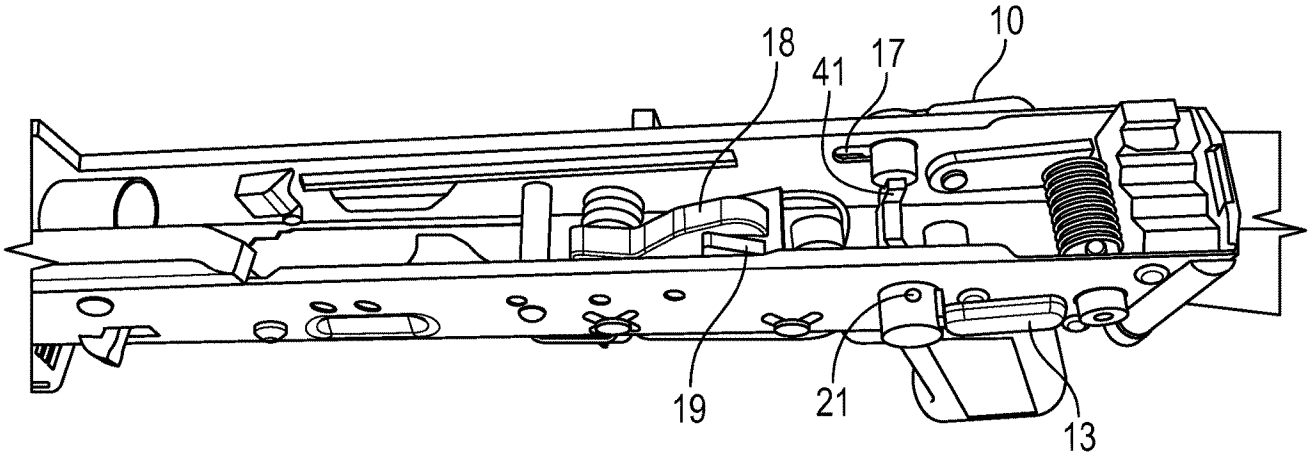
FIG. 7 is an isometric illustration of the position of an embodiment, in one form, of the bolt hold open, fire selector and safety in a Kalashnikov style weapon when in the semi-automatic fire configuration.

FIG. 6 and FIG. 7 show an embodiment of an installed bolt hold open, fire selector and safety in relation to other internal parts of a Kalashnikov style weapon. FIG. 6 shows an installed embodiment configured in a safe configuration when the dust cover, recoil spring assembly and bolt carrier group have been removed and not yet reassembled. FIG. 7 shows an installed embodiment in the semi-automatic fire configuration when the dust cover, recoil spring assembly and bolt carrier group have been removed and not yet reassembled.

Both FIG. 6 and FIG. 7 show the relative positions of the hammer, 18, and the trigger assembly, 19, with respect to an embodiment of an installed bolt hold open, fire selector and safety in a Kalashnikov style weapon when the dust cover, recoil spring assembly and bolt carrier group have been removed and not yet reassembled.

Figure 8:
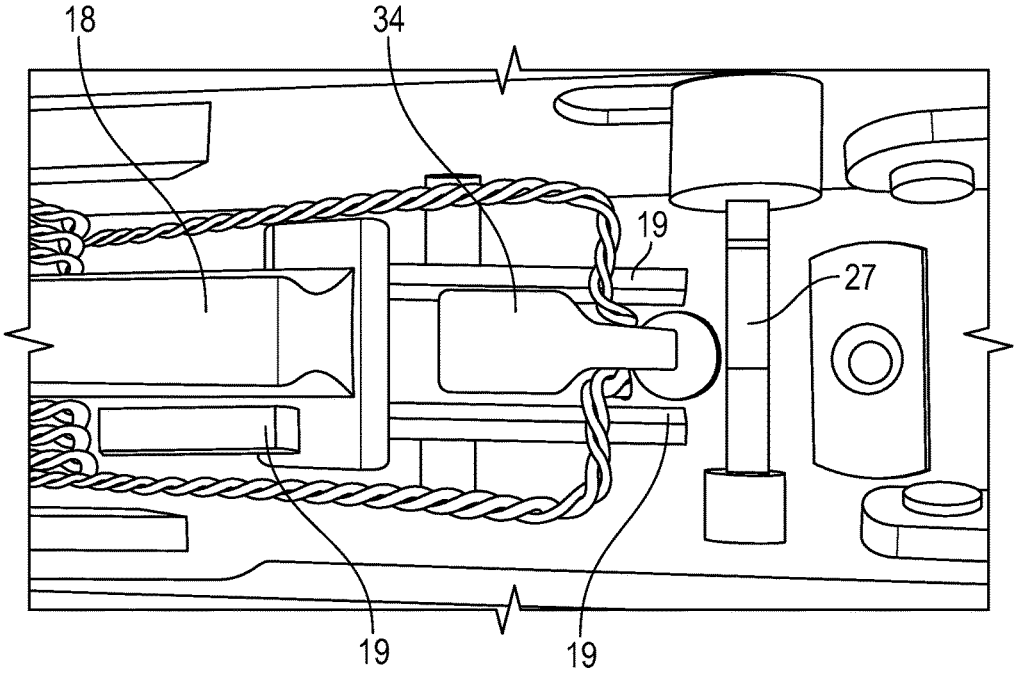
FIG. 8 is an isometric top down illustration of the position of an embodiment, in one form, of the bolt hold open, fire selector and safety in a Kalashnikov style weapon when in the semi-automatic fire configuration showing that in this position an embodiment of the means for blocking mechanism will not block either the disconnector or the trigger assembly and will thereby not operate to prevent the discharge of the weapon.
Figure 9:
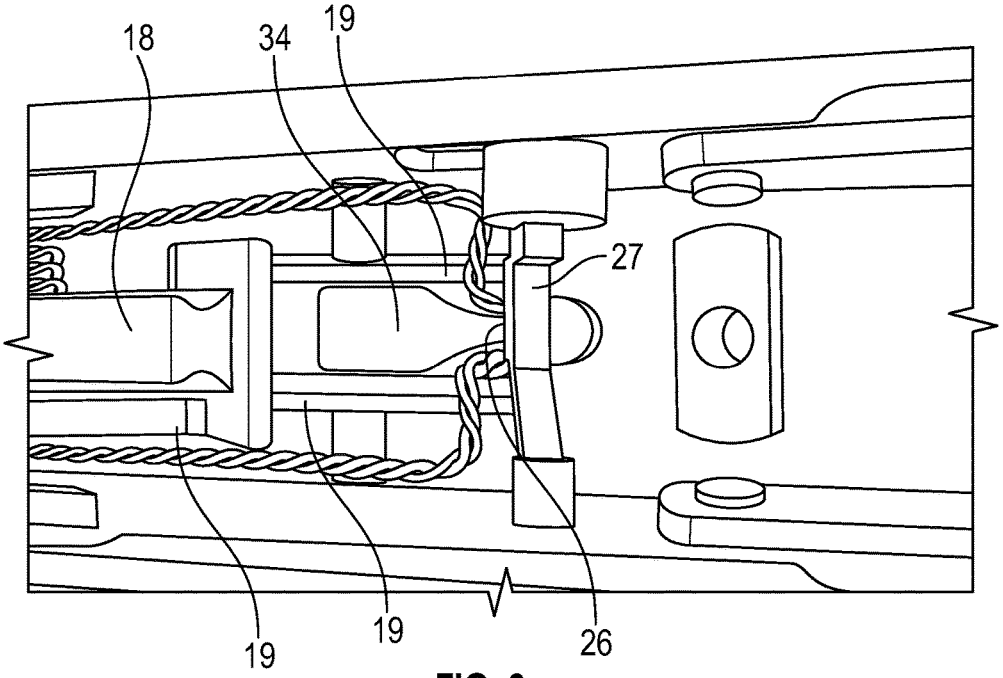
FIG. 9 is an isometric top down illustration of the position of an embodiment, in one form, of the bolt hold open, fire selector and safety in a Kalashnikov style weapon when in the safe configuration, showing how an embodiment of the means for blocking mechanism is capable of blocking the disconnector and the trigger assembly and thereby preventing the discharge of the weapon.

FIG. 9 additionally shows an isometric top down illustration of the position of an embodiment, in one form, of the bolt hold open, fire selector and safety in a Kalashnikov style weapon when in the safe configuration, showing how an embodiment of the means for blocking mechanism, 26, is capable of blocking the disconnector, 34, and the trigger assembly, 19, and thereby prevent the discharge of the weapon. In FIG. 9, the Kalashnikov style weapon's dust cover, recoil spring assembly and bolt carrier group are depicted as removed and not yet reassembled. Although the trigger assembly, 19, has several lead lines identifying it on both FIG. 8 and FIG. 9, each lead line identifies a portion of a single machined piece, which is difficult to illustrate because of its position within the Kalashnikov style weapon because in the embodiment shown, part of the trigger assembly extends under and wraps around the hammer, 18.

FIG. 8 additionally shows an isometric top down illustration of the position of an embodiment, in one form, of the bolt hold open, fire selector and safety in a Kalashnikov style weapon when in the semi-automatic fire configuration showing that in this position an embodiment of the means for blocking mechanism (which is located in this embodiment beneath the means for permitting reciprocation of the bolt carrier assembly, 27) will not block either the disconnector, 34, or the trigger assembly, 19, and will thereby not operate to prevent the discharge of the weapon. In FIG. 8, the Kalashnikov style weapon's dust cover, recoil spring assembly and bolt carrier group are depicted as removed and not yet reassembled.

Figure 10:
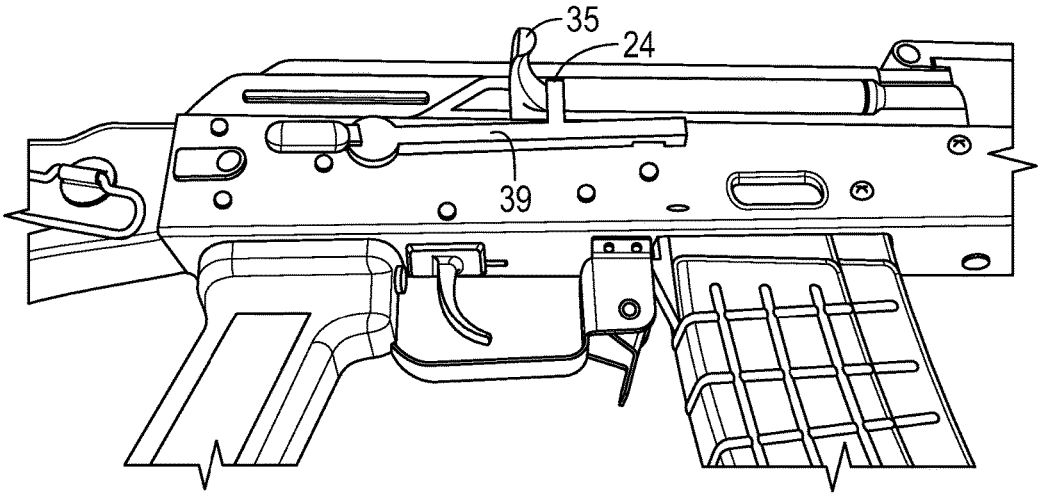
FIG. 10 is an isometric illustration of an embodiment, in one form, of the bolt hold open, fire selector and safety in a Kalashnikov style weapon when in the safe configuration and positioned to hold open the bolt carrier assembly.

FIG. 10 is an isometric illustration of an embodiment, in one form, of the bolt hold open, fire selector and safety in a Kalashnikov style weapon when in the safe configuration and positioned to hold open the bolt carrier assembly by being positioned in front of the charging handle, 35, after the charging handle has been manually pulled back by the user. FIG. 10 further depicts an embodiment, in one form, a rigid hold open member extending from the external part of the single rigid member of the primary selector piece so as to conformably engage the front of the firearm's charging handle in such a manner that prevents the bolt of the firearm from closing for so long as the hold open member is engaging the front of the firearm's charging handle, 24.

FIG. 10 further depicts an embodiment of an external part of the primary selector piece which extends laterally along the right receiver, 39.

Figure 11:
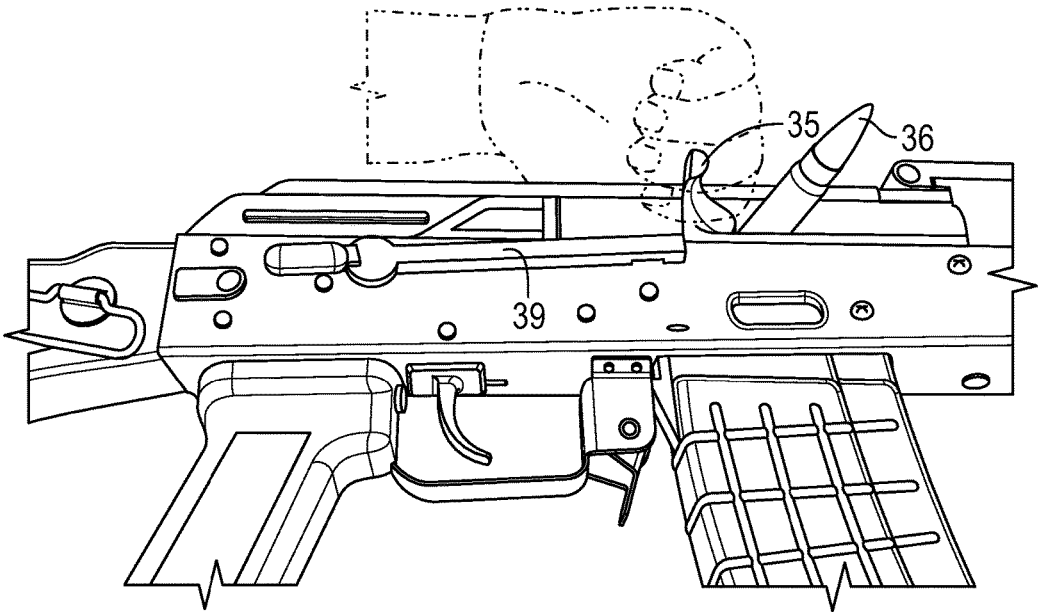
FIG. 11 is an isometric illustration of an embodiment, in one form, of the bolt hold open, fire selector and safety in a Kalashnikov style weapon when the primary selector piece is in the safe configuration and the user is pulling back the charging handle in order to eject a round from the chamber.

FIG. 11 is an isometric illustration of an embodiment, in one form, of the bolt hold open, fire selector and safety in a Kalashnikov style weapon when the primary selector piece is in the safe configuration and the user is pulling back the charging handle, 35, in order to eject a round, in one embodiment, 36, from the chamber. Although the round, 36, is shown as an unfired round, it could also be, in other embodiments, a casing from a fired round or a round of any type of ammunition other than that portrayed in FIG. 11.

While the description of several embodiments has been presented and while the illustrative embodiments are described in detail, it is not the intention of the applicant to restrict or in any way limit the scope of the appended claims to such detail. Applicant intends by this application to cover all possible embodiments that are described by the claims, even if such embodiments are not specifically shown or described in the Figures or in the Detailed Description of the Embodiments. That is, the claims in their broader aspects are therefore not limited to any of the specific details, representative apparatus and illustrative examples shown and described in the Figures and the specification. Accordingly, departures may be made from such details without departing from the spirit or scope of applicant's general concept as claimed.

Therefore I claim:

1. An apparatus for ambidextrously holding open the bolt of a Kalashnikov style firearm, for ambidextrously selecting whether the Kalashnikov style firearm will fire multiple rounds or a single round each time the user pulls and holds down the trigger on the firearm and for ambidextrously selecting whether the Kalashnikov style firearm will fire when the user pulls the trigger on the firearm when the Kalashnikov style firearm is equipped with a left receiver, a right receiver, a charging handle, an auto sear mounting pin, a primary keyhole, a secondary mounting hole, a bolt carrier assembly and a recoil spring assembly, a disconnector, a hammer and a trigger assembly, said apparatus comprising:

- a primary selector piece, comprising:
  - a single rigid member, comprising:
    - an external part which extends laterally along the right receiver, comprising:
      - a means for creating friction between the external part and the right receiver;
      - a means for conformably clearing the auto sear mounting pin by allowing the external part to pass over the auto sear mounting pin;
      - a rigid hold open member extending from the external part so as to conformably engage the front of the firearm's charging handle in such a manner that prevents the bolt of the firearm from closing for so long as the hold open member is engaging the front of the firearm's charging handle;
      - a right thumb piece operatively configured to provide leverage to a user rotating the primary selector piece;
    - an internal part which is approximately orthogonal to the external part and which extends through the primary keyhole in the right receiver and through the secondary mounting hole in the left receiver, comprising:

a means for pivoting on keyhole passthrough;

a means for blocking mechanism which is capable of blocking the disconnector and the trigger assembly;

a means for permitting reciprocation of bolt carrier assembly;

a means for pivoting on secondary mounting hole that possesses an insertion space conformably made to accommodate a means for fastening the primary selector piece to the left thumb piece;

a left thumb piece operatively configured to provide leverage to a user rotating the primary selector piece; and a means for fastening the primary selector piece to the left thumb piece.

2. An apparatus for ambidextrously selecting whether a Kalashnikov style firearm having a left receiver, a right receiver, an auto sear mounting pin, a primary keyhole, a secondary mounting hole, a hammer and a trigger assembly will fire when the user pulls the trigger on the firearm, said apparatus comprising:

a primary selector piece, comprising:

a single rigid member, comprising:

an external part which extends laterally along the right receiver, comprising:

a means for creating friction between the external part and the right receiver;

a means for conformably clearing the auto sear mounting pin by allowing the external part to pass over the auto sear mounting pin;

a right thumb piece operatively configured to provide leverage to a user rotating the primary selector piece;

an internal part which is approximately orthogonal to the external part and which extends through the primary keyhole in the right receiver and through the secondary mounting hole in the left receiver, comprising:

a means for pivoting on keyhole passthrough;

a means for blocking mechanism which is capable of blocking the trigger assembly a means for permitting reciprocation of bolt carrier assembly;

a means for pivoting on secondary mounting hole that possesses an insertion space conformably made to accommodate a means for fastening the primary selector piece to the left thumb piece;

a left thumb piece operatively configured to provide leverage to a user rotating the primary selector piece; and a means for fastening the primary selector piece to the left thumb piece.

3. An apparatus for ambidextrously selecting whether the Kalashnikov style firearm will fire multiple rounds or a single round each time the user pulls and holds down the trigger on the firearm and for ambidextrously selecting whether the Kalashnikov style firearm will fire when the user pulls the trigger on the firearm when the Kalashnikov style firearm is equipped with a left receiver, a right receiver, a charging handle, an auto sear mounting pin, a primary keyhole, a secondary mounting hole, a bolt carrier assembly and a recoil spring assembly, a disconnector, a hammer and a trigger assembly, said apparatus comprising:

a primary selector piece, comprising:

a single rigid member, comprising:

an external part which extends laterally along the right receiver, comprising:

a means for creating friction between the external part and the right receiver;

a means for conformably clearing the auto sear mounting pin by allowing the external part to pass over the auto sear mounting pin;

a rigid hold open member extending from the external part so as to conformably engage the front of the firearm's charging handle in such a manner that prevents the bolt of the firearm from closing for so long as the hold open member is engaging the front of the firearm's charging handle;

a right thumb piece operatively configured to provide leverage to a user rotating the primary selector piece;

an internal part which is approximately orthogonal to the external part and which extends through the primary keyhole in the right receiver and through the secondary mounting hole in the left receiver, comprising:

a means for pivoting on keyhole passthrough;

a means for blocking mechanism which is capable of blocking the disconnector and the trigger assembly;

a means for permitting reciprocation of bolt carrier assembly;

a means for pivoting on secondary mounting hole that possesses an insertion space conformably made to accommodate a means for fastening the primary selector piece to the left thumb piece;

a left thumb piece operatively configured to provide leverage to a user rotating the primary selector piece; and a means for fastening the primary selector piece to the left thumb piece.

4. An apparatus for ambidextrously holding open the bolt of a Kalashnikov style firearm, for ambidextrously selecting whether the Kalashnikov style firearm will fire a single round each time the user pulls and holds down the trigger on the firearm and for ambidextrously selecting whether the Kalashnikov style firearm will fire when the user pulls the trigger on the firearm when the Kalashnikov style firearm is equipped with a left receiver, a right receiver, a charging handle, a primary keyhole, a secondary mounting hole, a bolt carrier assembly and a recoil spring assembly, a disconnector, a hammer and a trigger assembly, said apparatus comprising:

a primary selector piece, comprising:

a single rigid member, comprising:

an external part which extends laterally along the right receiver, comprising:

a means for creating friction between the external part and the right receiver;

a rigid hold open member extending from the external part so as to conformably engage the front of the firearm's charging handle in such a manner that prevents the bolt of the firearm from closing for so long as the hold open member is engaging the front of the firearm's charging handle;

a right thumb piece operatively configured to provide leverage to a user rotating the primary selector piece;

an internal part which is approximately orthogonal to the external part and which extends through the primary keyhole in the right receiver and through the secondary mounting hole in the left receiver, comprising:

a means for pivoting on keyhole passthrough;

a means for blocking mechanism which is capable of blocking the disconnector and the trigger assembly;

a means for permitting reciprocation of bolt carrier assembly;

a means for pivoting on secondary mounting hole that possesses an insertion space conformably made to accommodate a means for fastening the primary selector piece to the left thumb piece;

a left thumb piece operatively configured to provide leverage to a user rotating the primary selector piece; and a means for fastening the primary selector piece to the left thumb piece.

5. An apparatus for ambidextrously selecting whether a Kalashnikov style firearm having a left receiver, a right receiver, a primary keyhole, a secondary mounting hole, a hammer and a trigger assembly will fire when the user pulls the trigger on the firearm, said apparatus comprising:

a primary selector piece, comprising:

a single rigid member, comprising:

an external part which extends laterally along the right receiver, comprising:

a means for creating friction between the external part and the right receiver;

a right thumb piece operatively configured to provide leverage to a user rotating the primary selector piece;

an internal part which is approximately orthogonal to the external part and which extends through the primary keyhole in the right receiver and through the secondary mounting hole in the left receiver, comprising:

a means for pivoting on keyhole passthrough;

a means for blocking mechanism which is capable of blocking the trigger assembly a means for permitting reciprocation of bolt carrier assembly;

a means for pivoting on secondary mounting hole that possesses an insertion space conformably made to accommodate a means for fastening the primary selector piece to the left thumb piece;

a left thumb piece operatively configured to provide leverage to a user rotating the primary selector piece; and a means for fastening the primary selector piece to the left thumb piece.

6. An apparatus for ambidextrously selecting whether the Kalashnikov style firearm will fire a single round each time the user pulls and holds down the trigger on the firearm and for ambidextrously selecting whether the Kalashnikov style firearm will fire when the user pulls the trigger on the firearm when the Kalashnikov style firearm is equipped with a left receiver, a right receiver, a charging handle, a primary keyhole, a secondary mounting hole, a bolt carrier assembly and a recoil spring assembly, a disconnector, a hammer and a trigger assembly, said apparatus comprising:

a primary selector piece, comprising:

a single rigid member, comprising:

an external part which extends laterally along the right receiver, comprising:

a means for creating friction between the external part and the right receiver;

a rigid hold open member extending from the external part so as to conformably engage the front of the firearm's charging handle in such a manner that prevents the bolt of the firearm from closing for so long as the hold open member is engaging the front of the firearm's charging handle;

a right thumb piece operatively configured to provide leverage to a user rotating the primary selector piece;

an internal part which is approximately orthogonal to the external part and which extends through the primary keyhole in the right receiver and through the secondary mounting hole in the left receiver, comprising:

a means for pivoting on keyhole passthrough;

a means for blocking mechanism which is capable of blocking the disconnector and the trigger assembly;

a means for permitting reciprocation of bolt carrier assembly;

a means for pivoting on secondary mounting hole that possesses an insertion space conformably made to accommodate a means for fastening the primary selector piece to the left thumb piece;

a left thumb piece operatively configured to provide leverage to a user rotating the primary selector piece; and a means for fastening the primary selector piece to the left thumb piece.

7. The means for pivoting on keyhole passthrough as recited in claim 1 wherein the radial cross-section of said means for pivoting on keyhole passthrough comprises a shape selected from the group consisting of: a polygon, an ellipse and a circle.

8. The means for pivoting on keyhole passthrough as recited in claim 2 wherein the radial cross-section of said means for pivoting on keyhole passthrough comprises a shape selected from the group consisting of: a polygon, an ellipse and a circle.

9. The means for pivoting on keyhole passthrough as recited in claim 3 wherein the radial cross-section of said means for pivoting on keyhole passthrough comprises a shape selected from the group consisting of: a polygon, an ellipse and a circle.

10. The means for pivoting on keyhole passthrough as recited in claim 4 wherein the radial cross-section of said means for pivoting on keyhole passthrough comprises a shape selected from the group consisting of: a polygon, an ellipse and a circle.

11. The means for pivoting on keyhole passthrough as recited in claim 5 wherein the radial cross-section of said means for pivoting on keyhole passthrough comprises a shape selected from the group consisting of: a polygon, an ellipse and a circle.

12. The means for pivoting on keyhole passthrough as recited in claim 6 wherein the radial cross-section of said means for pivoting on keyhole passthrough comprises a shape selected from the group consisting of: a polygon, an ellipse and a circle.

13. The means for pivoting on secondary mounting hole as recited in claim 1 wherein the radial cross-section of said means for pivoting on secondary mounting hole comprises a shape selected from the group consisting of: a polygon, an ellipse and a circle.

14. The means for pivoting on secondary mounting hole as recited in claim 2 wherein the radial cross-section of said means for pivoting on secondary mounting hole comprises a shape selected from the group consisting of: a polygon, an ellipse and a circle.

15. The means for pivoting on secondary mounting hole as recited in claim 3 wherein the radial cross-section of said means for pivoting on secondary mounting hole comprises a shape selected from the group consisting of: a polygon, an ellipse and a circle.

16. The means for pivoting on secondary mounting hole as recited in claim 4 wherein the radial cross-section of said means for pivoting on secondary mounting hole comprises a shape selected from the group consisting of: a polygon, an ellipse and a circle.

17. The means for pivoting on secondary mounting hole as recited in claim 5 wherein the radial cross-section of said means for pivoting on secondary mounting hole comprises a shape selected from the group consisting of: a polygon, an ellipse and a circle.

18. The means for pivoting on secondary mounting hole as recited in claim 6 wherein the radial cross-section of said means for pivoting on secondary mounting hole comprises a shape selected from the group consisting of: a polygon, an ellipse and a circle.

19. The means for fastening the primary selector piece to the left thumb piece as recited in claim 1 wherein said means for fastening the primary selector piece to the left thumb piece comprises a fastener selected from the group consisting of a socket set screw, a roll pin, a nail, a screw, a weld, an epoxy, an adhesive, a magnet, a friction fit and a hitch pin.

20. The means for fastening the primary selector piece to the left thumb piece as recited in claim 2 wherein said means for fastening the primary selector piece to the left thumb piece comprises a fastener selected from the group consisting of a socket set screw, a roll pin, a nail, a screw, a weld, an epoxy, an adhesive, a magnet, a friction fit and a hitch pin.

21. The means for fastening the primary selector piece to the left thumb piece as recited in claim 3 wherein said means for fastening the primary selector piece to the left thumb piece comprises a fastener selected from the group consisting of a socket set screw, a roll pin, a nail, a screw, a weld, an epoxy, an adhesive, a magnet, a friction fit and a hitch pin.

22. The means for fastening the primary selector piece to the left thumb piece as recited in claim 4 wherein said means for fastening the primary selector piece to the left thumb piece comprises a fastener selected from the group consisting of a socket set screw, a roll pin, a nail, a screw, a weld, an epoxy, an adhesive, a magnet, a friction fit and a hitch pin.

23. The means for fastening the primary selector piece to the left thumb piece as recited in claim 5 wherein said means for fastening the primary selector piece to the left thumb piece comprises a fastener selected from the group consisting of a socket set screw, a roll pin, a nail, a screw, a weld, an epoxy, an adhesive, a magnet, a friction fit and a hitch pin.

24. The means for fastening the primary selector piece to the left thumb piece as recited in claim 6 wherein said means for fastening the primary selector piece to the left thumb piece comprises a fastener selected from the group consisting of a socket set screw, a roll pin, a nail, a screw, a weld, an epoxy, an adhesive, a magnet, a friction fit and a hitch pin.

* * * * *